US005197814A

United States Patent [19]

Lombardi et al.

[11] Patent Number: 5,197,814

[45] Date of Patent: Mar. 30, 1993

[54] LIPSTICK ARTICLE

[75] Inventors: Michael H. Lombardi; John Vaccaro, both of Stamford, Conn.

[73] Assignee: Elizabeth Arden Co., Division of Conopco, Inc., New York, N.Y.

[21] Appl. No.: 720,112

[22] Filed: Jun. 24, 1991

[51] Int. Cl.[5] ..... A45D 40/04

[52] U.S. Cl. ..... 401/78; 401/202; 401/247; 401/98

[58] Field of Search ..... 401/75-78, 401/202, 98, 247, 69

[56] References Cited

U.S. PATENT DOCUMENTS

| | | | |
|---|---|---|---|
| 2,867,357 | 1/1959 | Schneider et al. | 401/202 X |
| 3,150,771 | 9/1964 | Seaver | 401/98 |
| 3,830,404 | 8/1974 | Frazer | 401/190 X |
| 4,111,567 | 9/1978 | Berghahn et al. | 401/202 |
| 4,512,102 | 4/1985 | Ackerman et al. | 401/78 |
| 4,621,935 | 11/1986 | Sussman | 401/75 X |
| 4,648,908 | 3/1987 | Takasuka et al. | 106/417 |
| 4,792,251 | 12/1988 | Ryder | 401/78 X |
| 4,813,801 | 3/1989 | Cardia | 401/78 X |
| 4,865,479 | 12/1989 | Doll | 401/202 X |
| 4,936,700 | 6/1990 | Morris | 401/202 X |
| 5,061,105 | 10/1990 | Isoda | 401/202 |

FOREIGN PATENT DOCUMENTS 61-83110 4/1986 Japan .

*Primary Examiner*—Danton D. DeMille
*Attorney, Agent, or Firm*—Milton L. Honig

[57] ABSTRACT

A lipstick article is provided which houses a lipstick with a water content of from 0.5 to 30% by weight. The lipstick is packaged in a casing including a base, an elongated cylindrical inner body received in the base and containing the lipstick, a device for elevating-retracting the lipstick from within the inner body, a hollow elongated cap fitting over the inner body, and a hollow elongated plug sleeve inserted within the cap and formed of a material more flexible than a material forming the cap, the plug sleeve sealingly contacting an outer wall of the inner body to prevent evaporation of water from the lipstick.

1 Claim, 5 Drawing Sheets

FIG.1
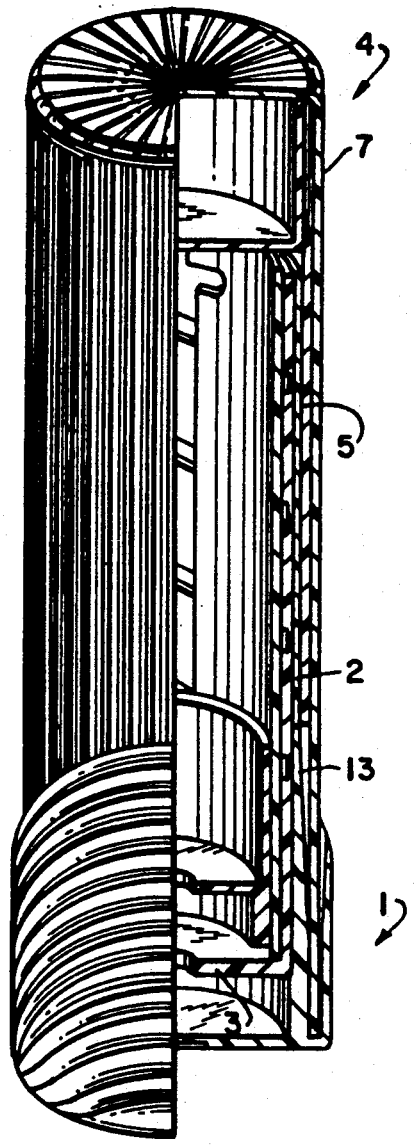
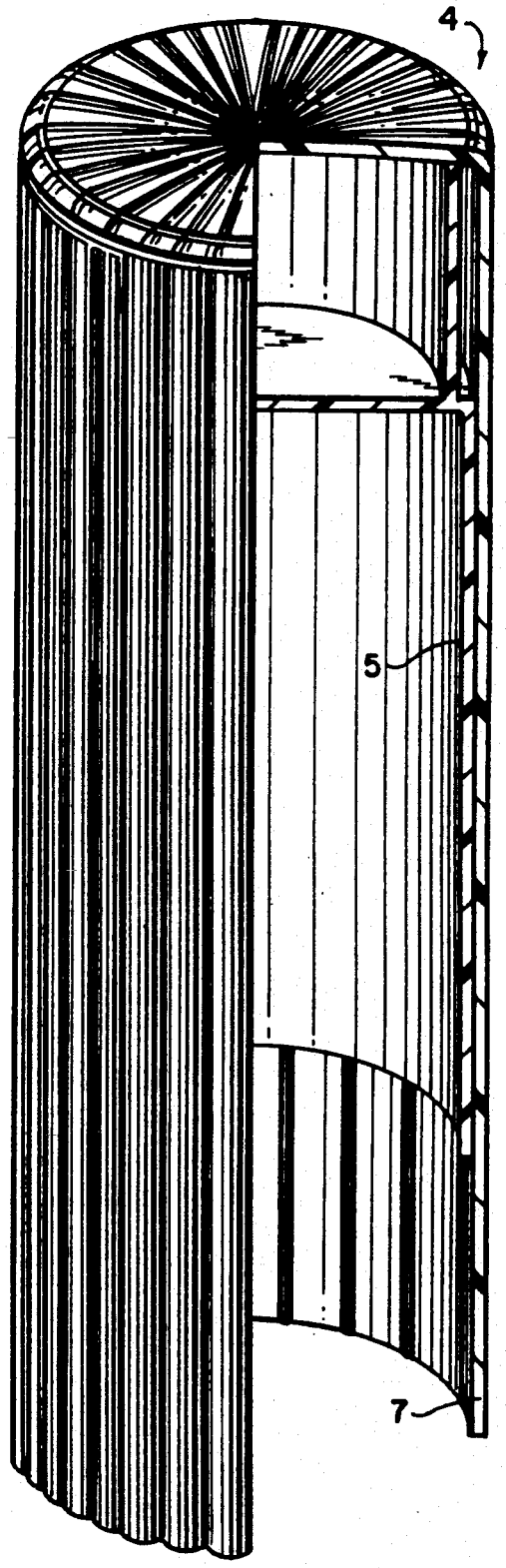
FIG.2

LIPSTICK ARTICLE

BACKGROUND OF THE INVENTION

1. Field of the Invention

The invention concerns a lipstick article which includes a water-containing lipstick formula within a casing that prevents moisture loss.

2. The Related Art

Traditional lipsticks are formulated with hydrophobic ingredients such as oils and waxes. Water is ordinarily not present in such formulations.

There has been reported in JP-A-61/83110 published Apr. 26, 1986, a lipstick containing small amounts of water. There is also a co-pending application to Dunphy et al., Ser. No. 558,140, filed Jul. 25, 1990, which discusses use of special emulsifiers to achieve homogeneous water incorporation into traditional lipstick compositions.

Expected shelf life of a lipstick sometimes may be as long as 2.5 to 3 years. Even when not stored above room temperature, we have noted that there is loss of moisture over time. This loss can adversely affect the physical properties of the product as well as reduce moisture delivery to the lips. Presently available commercial packages have been found to be unsuitable for retaining moisture in the new type of lipstick product. These packages have caps whose inner walls are either smooth or fashioned with several longitudinally running ribs. Neither the smooth wall nor ribs provide sufficient barrier for vapor loss.

Accordingly it is an object of the present invention to provide a package for a water containing lipstick formula that will prevent loss of moisture.

Another object of the present invention is to provide a package for a water containing lipstick formula wherein most components of existing standard casings can still be employed thereby minimizing package retooling costs.

It is still a further object of the present invention to provide a package for a water containing lipstick formula that provides good moisture-sealing properties while at the same time being a relatively simple device that avoids interference with package aesthetics.

SUMMARY OF THE INVENTION

A lipstick article is provided which comprises:

(i) a lipstick with a water content of from about 0.5 to 20% by weight;

(ii) a package base;

(iii) an elongated cylindrical inner body having a lower portion received in the package base and the lipstick being received in the inner body;

(iv) a means for elevating and retracting the lipstick along a length of the inner body, and the means being formed therewithin;

(v) a hollow elongated cap fitting over and covering the inner body; and (vi) a hollow elongated plug sleeve inserted within the cap and formed of a material more flexible than a material forming the cap, the plug sleeve sealingly contacting an outer wall of the inner body to prevent evaporation of the water from the lipstick.

There are two embodiments of the present invention; one of these being related to an all-plastic package, the other being related to an at least partially metal fabricated package. In the first embodiment the plug sleeve has a smooth inner wall with sealing being further accomplished by a plurality of nibs within the base surrounding the body and serving to catch an open-end of the cap.

The second embodiment utilizes a two-piece metal base and inner body. Here the hollow plug sleeve at an open end thereof has a tapered inner wall. Advantageously, there may also be an inwardly projecting ring circumferentially along the inner wall of the plug sleeve between the taper and a closed end of the plug sleeve. Within the inner body there is included a cup bearing the lipstick. At least one aperture is formed in the bottom of the cup. There is also a means below the aperture for sealing the aperture when the cup is in a retracted position. A plastic insert or a hot melt adhesive body may serve as the sealing means.

BRIEF DESCRIPTION OF THE DRAWING

Further objects, features and advantages of the present invention will better be understood in light of the embodiment examples which are discussed below with the aid of a drawing wherein:

FIG. 1 is a side perspective and partially cutaway view of a first embodiment of the lipstick article according to the present invention;

FIG. 2 is a side perspective and partially cutaway view of cap and plug sleeve components of FIG. 1;

DETAILED DESCRIPTION

Figure 3:
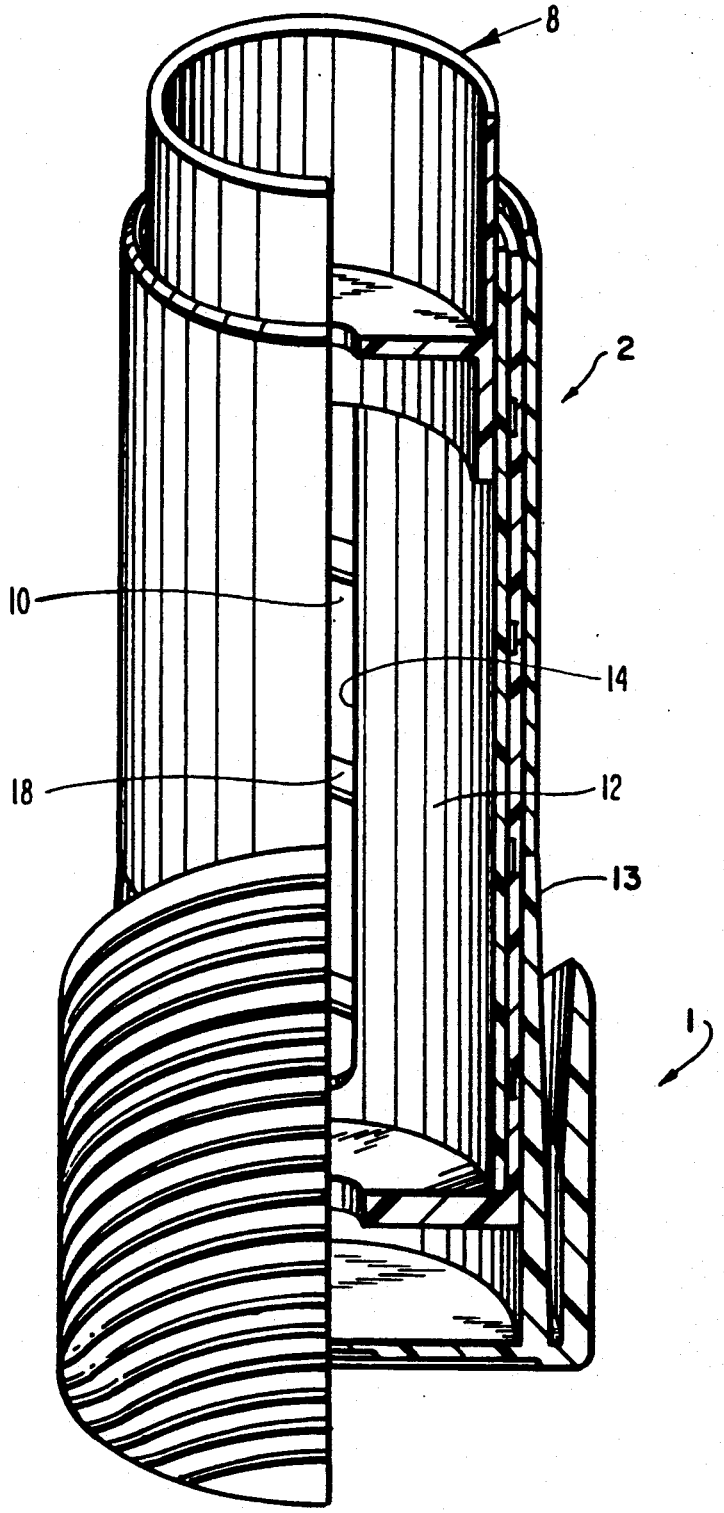
FIG. 3 is a side perspective and partially cutaway view of the base and inner body components of FIG. 1.

A system has now been devised which insures against the loss of moisture from the lipstick article of the present invention. Before discussion of the mechanical aspects of this invention, it is important to describe the new water-containing lipstick from which the problem of this invention arises and which constitutes an integral part of the present invention.

Lipsticks of the present invention will include a certain amount of water in combination with oils, waxes, emulsifiers and, optionally, pigments. Water is an essential component and may range in amount anywhere from about 0.5 to about 30%, preferably from about 1 to about 20%, optimally between about 2 and 10% by weight. Oils are normally included in compositions of the present invention at levels from about 2 to about 97%, preferably from about 30 to 70% by weight of the composition. These oils are useful for a variety of purposes such as to impart viscosity, tackiness, drag and emollient properties. A chosen oil will normally be liquid at room temperature, (i.e. 20° C.), and can comprise a single oil or a mixture of two or more oils. Examples of suitable oils include caprylic triglycerides; capric triglycerides; isostearic triglycerides; adipic triglycerides; propylene glycol myristyl acetate; lanolin oil; polybutene; isopropyl palmitate; isopropyl myristate; diethyl sebacate; diisopropyl adipate; hexadecyl stearate; cetyl oleate; oleyl alcohol; hexadecyl alcohol; wheatgerm oil; hydrogenated vegetable oils; petrolatum; modified lanolins; branched-chain hydrocarbons, alcohols and esters; castor oil; corn oil; cottonseed oil; olive oil; palm kernel oil; rapeseed oil; safflower seed oil; jojoba oil; evening primrose oil; avocado oil; mineral oil; and volatile and non-volatile silicone oils.

An emulsifier system will normally also be present in the lipsticks of the invention. Total levels of emulsifier may range from about 0.2 to about 10% by weight. Combinations of emulsifiers may be particularly useful, for instance, combinations of phospholipids combined with fatty acid derivatives. Examples of phospholipids are those within the categories of phosphoglycerides, lysophosphoglycerides, sphingomyelins and mixtures thereof. Especially useful as a phospholipid is lecithin. Fatty acid derivative-type emulsifiers may be of the type including monoacyl glycerol, diacyl glycerol and polyglycerol esters and combinations thereof. Especially preferred are glycerol monoalkanoates, an example of which are the monoglycerides of sunflower seed oil and of palm oil.

Waxes may optionally be present in amounts ranging from about 1 to about 30%, preferably from about 5 to 20% by weight. Examples of waxes include candelilla wax, ozokerite wax, carnauba wax, beeswax, spermaceti, cetyl alcohol and stearyl alcohol. Pigments are here defined as including both inorganic compounds and organic dyes which may be present in amounts from about 0.5 to about 15%, preferably from about 2 to 10% by weight. Examples of pigments include inorganic salts such as bismuth oxychloride, iron oxide, titanium dioxide and mica. Organic dyes which may serve as pigments include Blue 1 Aluminum Lakes, Red 6 Barium Lakes, Red 7 Calcium Lakes, Red 21 Aluminum Lakes, Red 27 Aluminum Lakes, Red 27 Zirconium Lakes, Yellow 5 Aluminum Lakes, Yellow 6 Aluminum Lakes, Carmine, Manganese Violet, Orange 5, Red 21, Red 27, Red 36 and mixtures thereof.

Skin active ingredients in the form of both water-soluble and insoluble substances may be included within the lipstick formulations of this invention. These ingredients may range anywhere from about 0.0001 to about 10% by weight. Examples include zinc oxide; $\beta$-glycyrrhetic acid; chamomile oil; ginko biloba extract; pyroglutamic acid, salts or esters; sodium hyaluronate; 2-hydroxyoctanoic acid; sulphur; salicylic acid; carboxymethyl cysteine and mixtures thereof.

Now that the chemistry of the lipstick has been fully described, mechanical aspects of the present invention are set forth.

FIG. 1 provides a partially cutaway view of a first or promotional embodiment of the present invention. The housing for the lipstick includes a package base 1, an elongated cylindrical inner body 2, an elevating-retracting system 3, a hollow elongated cap 4 and a hollow elongated plug sleeve 5

FIG. 2 provides a partially cutaway view of the hollow elongated cap 4. Tightly fitting within cap 4 is the hollow elongated plug sleeve 5. According to the first embodiment of this invention, plug sleeve 5 has a smooth inner wall which stretches more than halfway (between 50 and 90%) of a length of the cylindrical wall 7 forming cap 4. Preferably the plug sleeve inner wall length is about 80% that of the wall 7.

An important feature of the present invention is that the plug sleeve is formed of a material which is more flexible than material forming the cap. Flexibility is important to allow the plug sleeve to elastically engage over an outer wall of inner body 2. Advantageously the plug sleeve material will have a flexural modulus (at 73° F. under ASTM 790 Method) from about 10 to about 500, preferably from about 35 to about 250, optimally between about 100 and about 200 ($\times 10^3$ psi). On the other hand, the flexural modulus of the material forming the cap will range from about 250 to over 5,000, preferably between about 300 and about 2,500 ($\times 10^3$ psi).

Another important property of the plug sleeve material is that it requires a water vapor transmission rate (at 37.8° C./24 hr. under ASTM E96-E Method) of from nil to at most 5, preferably at most 0.5, optimally at most 0.2 g-mm/m$^2$. Particularly preferred for this use is high density polyethylene with possible other materials being polypropylene and polyethylene terephthalate.

Cap 4 will be constructed of a relatively hard material such as polypropylene, ABS (acrylonitrile-butadiene-styrene), SAN (styrene-acrylonitrile) and combinations of ABS with SAN. Particularly preferred for the first embodiment of this invention is a 40:60 blend of SAN:ABS. Metallic material may also be utilized for the cap as well as base and inner body. Brass or chrome plated metal are particularly preferred.

Figure 5:
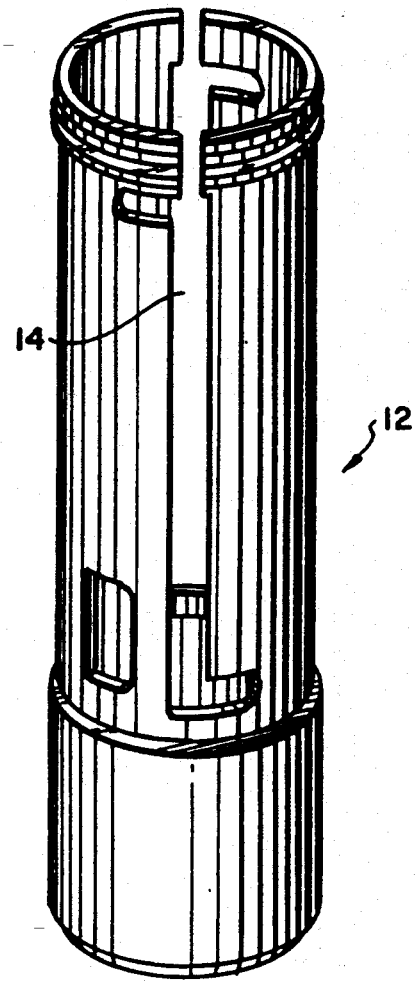
FIG. 5 is a cutaway perspective view of a track guide according to the embodiment of FIG. 1.
Figure 6:
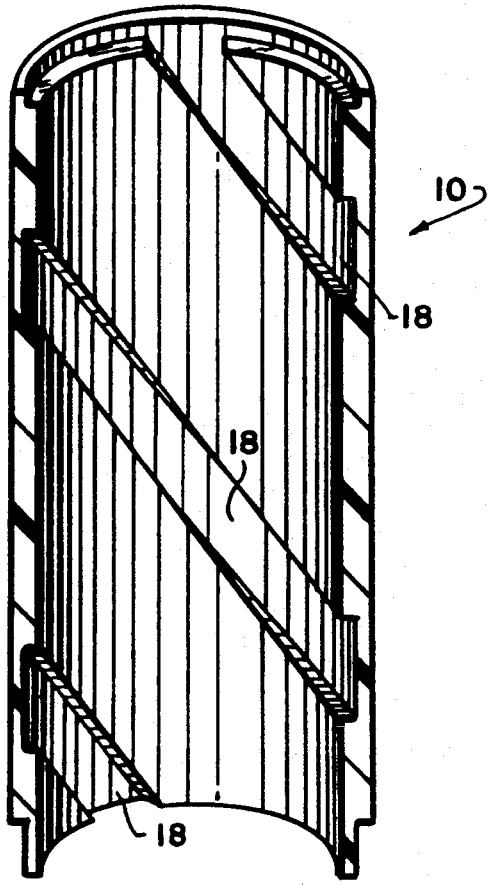
FIG. 6 is a cutaway perspective view of a double-threaded track surrounding the track guide of FIG. 3 and inserted within the inner body shown in FIG. 1.
Figure 8:
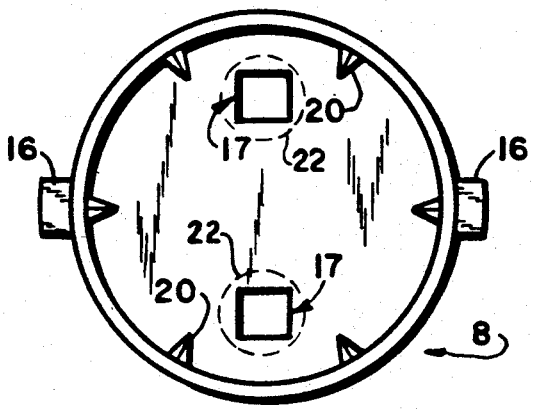
FIG. 8 is a top view looking downward into the ribbed cup of FIG. 7.
Figure 7:
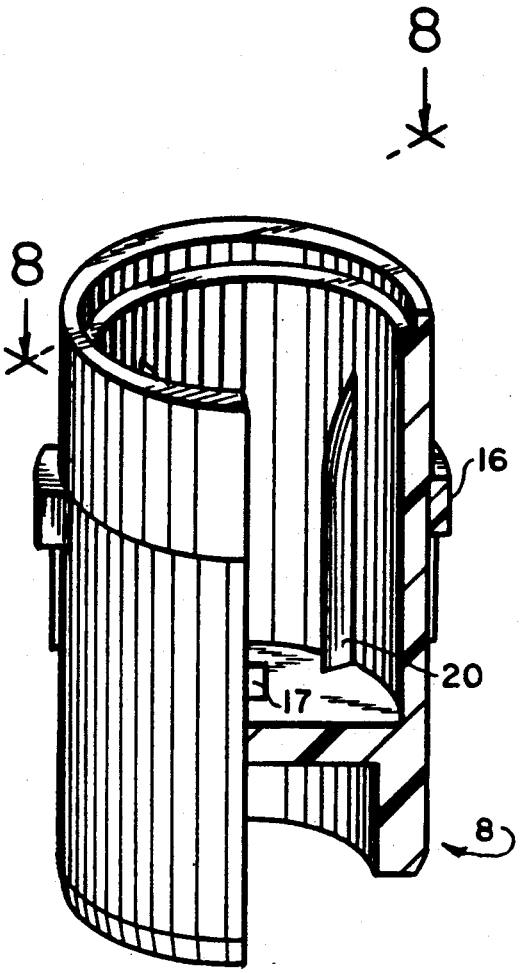
FIG. 7 is a cutaway perspective view of a ribbed cup for holding the lipstick.

FIG. 5 through FIG. 8 illustrate components cf the system for elevating-retracting the lipstick within inner body 2. The system is based upon a cam mechanism comprising a carrier cup 8, a spiral insert 10 and a cam track 12. FIG. 5 illustrates the cam track 12 which includes a guide slot 14 along which a cam 16 can be directed. FIG. 6 illustrates the spiral insert 10 in which a double-threaded track 18 is slantingly formed. FIG. 7 and 8 illustrate carrier cup 8 which contains a series of ribs 20 for holding lipstick 30 and on an outer wall bears cams 16 projecting outwardly. Assembled, the cam mechanism will position ribbed carrier cup 8 within cam track 12 which, in turn, will be within spiral insert 10. The full assembly is then positioned within inner body 2. Base 1 is formed to receive a lower portion of inner body 2 such that these components rotatingly communicate with one another. Rotation is actuated through a twisting movement of base 1 whereupon the ribbed carrier cup 8 with lipstick is slidingly engaged to move upwards along guide slot 14 by the action of double-threaded track 18.

Figure 9:
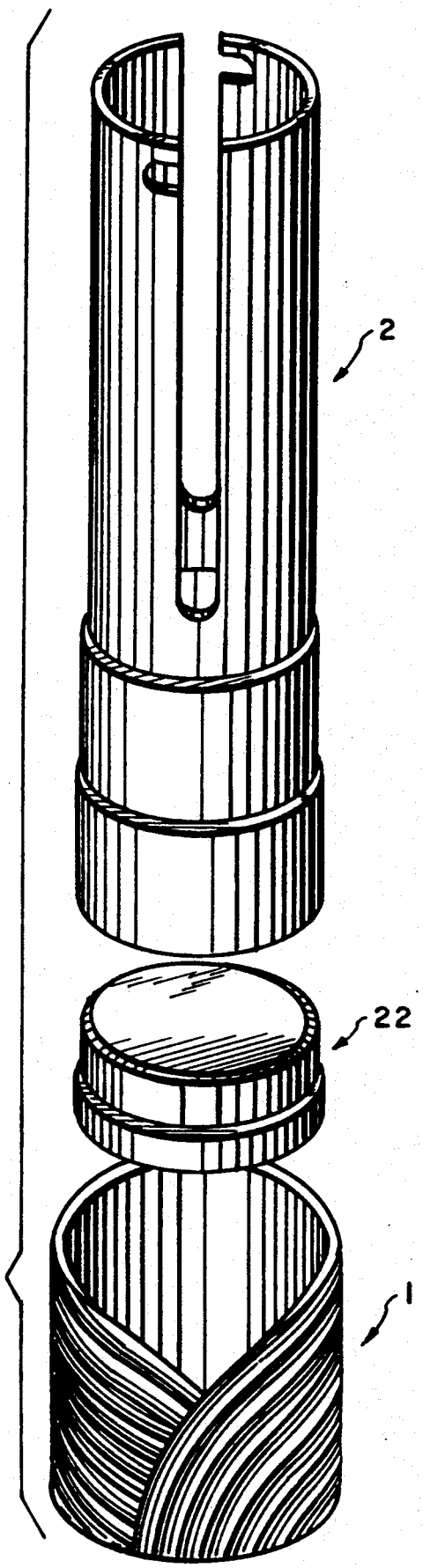
FIG. 9 is a separated elevational view of the inner body, seal insert and base according to the second embodiment of the invention.
Figure 10:
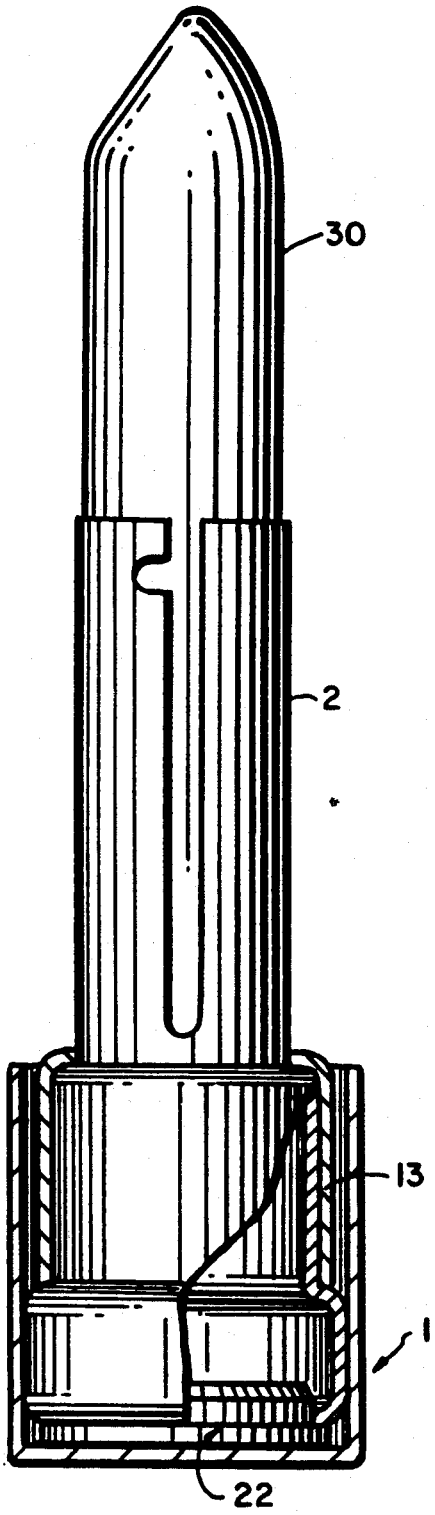
FIG. 10 is an exposed, partially cutaway view of the inner body and base as assembled from FIG. 9 including a lipstick.

FIG. 9 and 10 illustrate the combination of the inner body 2, the cam mechanism and base 1.

All known commercial lipstick carriers such as carrier cup 8 include at least one aperture 17 in a floor of the carrier. This aperture permits relief of pressure which is built up by insertion of the lipstick into the carrier during manufacturing. Within the context of this invention, it is important that there be a seal 22 to prevent air communication through the aperture between the interior of carrier 8 and the outside atmosphere. Seal 22 may be accomplished through use of an elastic insert, or more preferably, an adhesive seal in the form of a hot melt adhesive. Suitable hot melt adhesives may be those of the acrylate or vinyl acetate polymer and copolymer type.

Figure 4:
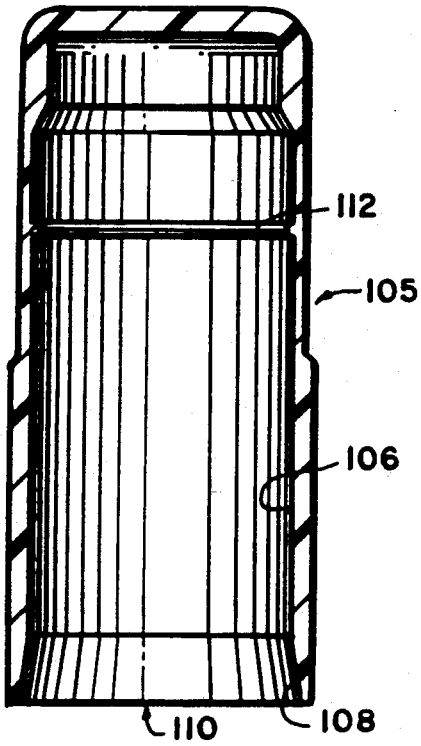
FIG. 4 is a cross-sectional view of a plug sleeve forming a second embodiment of the lipstick article according to the present invention.
Figure 11:
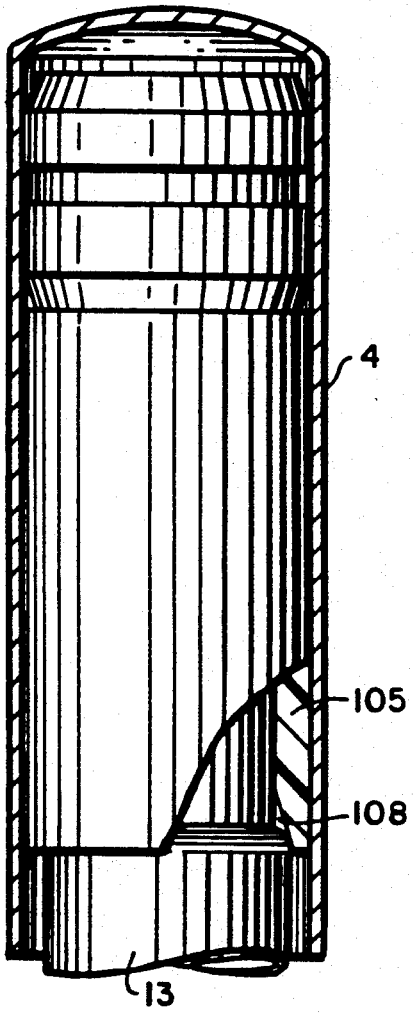
FIG. 11 is a cross-sectional and partially cutaway view of the plug sleeve of FIG. 4 engaging an outer surface of the inner body according to the second embodiment of the invention.

A second embodiment of the present invention employs a plug sleeve insert of slightly different configuration than that of the first embodiment. FIG. 4 presents a plug sleeve 105 having an inner wall 106 with a taper 108 at an open end 110 of the cylindrical sleeve. The taper is optimally 7°, but may range from about 2° to about 30°, preferably between about 5° and 10°, with respect to a plane parallel to a straight portion of inner wall 106. Taper 108 is dimensioned to engage over a stationary, outer collar 13 (see FIG. 1, 3 and 11) of inner body 2.

Since there is a tendency for taper 108 to slide upwardly away from engagement over collar 13, a friction ring 112 is positioned between open and closed ends of plug sleeve 105. Friction ring 112 is fashioned as a circumferentially inwardly projecting ledge molded on inner wall 106.

The following example will more fully illustrate certain aspects of the present invention. All parts, percentages and proportions referred to herein and in the appended claims are by weight unless otherwise indicated.

EXAMPLE

A series of experiments were performed to determine water evaporation levels as a function of utilizing a plug sleeve and/or hot melt adhesive under the aperture in the base. Friction ring 112 is intended as a stop to contact the upper end of the inner body 2. Lipstick articles were stored in a convection oven over a period of 16 weeks at temperatures of 70° F., 100° F. and 110° F. Every four weeks each of the lipstick articles were evaluated by weighing them to calculate weight loss and by performing a Karl Fischer water analysis. With regard to weight loss, it is to be noted that some loss was due to evaportion of the hot melt adhesive in those experiments containing same. Table I lists the results of these experiments.

TABLE I

| | Weight Loss | | |
|---|---|---|---|
| | RT (10)* | 100° (10)* | 110° (11)* |
| A. Control lipstick case with hot melt adhesive in base and standard cap (no plug sleeve) | 2.520% | 4.877% | 6.068% |
| B. Control lipstick case with LDPE plug sleeve | 1.703% | 1.775% | 5.605% |
| C. Control lipstick case with LDPE plug sleeve and hot melt adhesive in base | 1.713% | 4.522% | 5.493% |
| D. Control lipstick case with HDPE plug sleeve | 1.706% | 4.576% | 5.395% |
| E. Control lipstick case with HDPE plug sleeve and hot melt adhesive in base | .590% | 3.948% | 5.055% |
| F. Control case (no hot melt adhesive and no plug sleeve) | 1.629% | 4.648% | 5.434% |

*Number of samples tested

Karl Fischer water analyses were performed on test and control samples to determine the water level in each lipstick. Results are presented in a Table II.

TABLE II

| Test | Temperature | % Water |
|---|---|---|
| A | RT | 3.76 |
| | 100° | 2.23 |
| | 110° | 1.08 |
| B | RT | 3.61 |
| | 100° | 2.17 |
| | 110° | 1.24 |
| C | RT | 3.97 |
| | 100° | 1.73 |
| | 110° | 1.49 |
| D | RT | 3.18 |
| | 100° | 1.90 |
| | 110° | 1.80 |
| E | RT | 4.02 |
| | 100° | 4.00 |
| | 110° | 2.19 |
| F | RT | 3.75 |
| | 100° | 3.61 |
| | 110° | 2.17 |

From Tables I and II, it is evident that best results were obtained under condition "E", i.e. use of a high-density polyethylene plug insert combined with a hot melt adhesive in the base. Variable "E" had the lowest percent weight loss and retained the highest percent water under all conditions.

The foregoing description and example illustrate selected embodiments of the present invention. In light thereof, various modifications will be suggested to one skilled in the art, all of which are within the spirit and purview of this invention.

What is claimed is:

1. A lipstick article comprising:

(i) a lipstick with a water content of from about 0.5 to about 30% by weight;

(ii) a package base;

(iii) an elongated cylindrical inner body having a lower portion received in said package base and said lipstick being received in said inner body, said inner body including a cup bearing said lipstick, said cup having at least one aperture in a bottom thereof;

(iv) a means for elevating and retracting said lipstick within said inner body, and said means being formed therewithin;

(v) a hollow elongated cap fitting over and covering said inner body;

(vi) a hollow elongated plug sleeve inserted within said cap and formed of a material more flexible than a material forming said cap, said plug sleeve sealingly contacting an outer wall of said inner body to prevent evaporation of said water from said lipstick; and (vii) a means below said aperture for sealing said aperture when said cup is in a retracted position, said means for sealing being a body of hot melt adhesive.

* * * * *